US011752611B2

(12) United States Patent
Hutchison et al.

(10) Patent No.: US 11,752,611 B2
(45) Date of Patent: Sep. 12, 2023

(54) DEAD BLOW SLIDE HAMMER

(71) Applicant: Snap-on Incorporated, Kenosha, WI (US)

(72) Inventors: Allen M. Hutchison, Beach Park, IL (US); Benjamin T. Schulz, Oak Creek, WI (US); Jonathan I. Andersen, Racine, WI (US); Marco E. DeVecchis, Racine, WI (US)

(73) Assignee: Snap-on Incorporated

( * ) Notice: Subject to any disclaimer, the term of this patent is extended or adjusted under 35 U.S.C. 154(b) by 25 days.

(21) Appl. No.: 17/179,164

(22) Filed: Feb. 18, 2021

(65) Prior Publication Data

US 2022/0258318 A1 Aug. 18, 2022

(51) Int. Cl.

| | |
|---|---|
| ***B25D 1/12*** | (2006.01) |
| ***B25D 1/16*** | (2006.01) |
| ***B25G 1/10*** | (2006.01) |

(52) U.S. Cl.

CPC ..... *B25D 1/12* (2013.01); *B25D 1/16* (2013.01); *B25G 1/102* (2013.01)

(58) Field of Classification Search

CPC ... B25D 1/12; B25D 1/16; B25G 1/01; B25G 1/102; B25G 1/104; Y10T 29/5393

USPC ..... 81/22, 27, 463, 489, 491; 173/100, 101, 173/102, 103; 30/277; 72/457

See application file for complete search history.

(56) References Cited

U.S. PATENT DOCUMENTS

| | | | | |
|---|---|---|---|---|
| 2,737,216 | A | 3/1956 | Kenerson | |
| 2,989,101 | A | 6/1961 | Carmien | |
| 3,965,992 | A | 6/1976 | Swisher | |
| 4,458,415 | A * | 7/1984 | Maher | B28D 1/26 81/463 |
| 4,785,692 | A * | 11/1988 | Holmes | E01B 31/26 81/463 |
| 5,180,163 | A | 1/1993 | Lanctot et al. | |
| 5,375,487 | A | 12/1994 | Zimmerman | |
| 6,467,376 | B1 | 10/2002 | Wu | |
| 6,640,447 | B2 | 11/2003 | Wickline | |
| 6,904,829 | B2 | 6/2005 | Krallman | |
| 7,134,363 | B2 | 11/2006 | Krallman | |
| 7,409,747 | B2 * | 8/2008 | Chen | A45B 9/02 81/177.1 |

(Continued)

FOREIGN PATENT DOCUMENTS

| | | | |
|---|---|---|---|
| CN | 101652227 | A | 2/2010 |
| CN | 209207424 | U | 8/2019 |

(Continued)

OTHER PUBLICATIONS

DE-202018105187—Machine Translation (Year: 2019).*

(Continued)

*Primary Examiner* — Lee D Wilson

*Assistant Examiner* — Alberto Saenz

(74) *Attorney, Agent, or Firm* — Seyfarth Shaw LLP

(57) ABSTRACT

A dead blow slide hammer body with a through bore that receives and slides on a shaft. The hammer body includes one-or-more internal longitudinal cavities, lateral to the through bore, filled with a dampening material. When the hammer body sliding on the shaft strikes a slide stop, the dampening material creates a "dead blow" effect, increasing the duration of impact, while insulating a user from the shock.

6 Claims, 9 Drawing Sheets

(56) References Cited

U.S. PATENT DOCUMENTS

| | | | |
|---|---|---|---|
| 7,802,497 | B1 | 9/2010 | Hartzog et al. |
| 9,016,171 | B2 | 4/2015 | Chen |
| 9,056,229 | B2 | 6/2015 | Hungerbach et al. |
| 9,493,917 | B2 | 11/2016 | Lesche |
| 9,526,671 | B2 | 12/2016 | Weck et al. |
| 9,656,846 | B2 | 5/2017 | West |
| 9,828,738 | B2 | 11/2017 | Myrland et al. |
| 2007/0113709 | A1 | 5/2007 | Krallman |
| 2014/0076595 | A1 | 3/2014 | Belsey et al. |
| 2016/0177527 | A1 | 6/2016 | Myrland et al. |
| 2020/0078916 | A1 | 3/2020 | Henry |

FOREIGN PATENT DOCUMENTS

| | | | | |
|---|---|---|---|---|
| CN | 211681907 | U | 10/2020 | |
| CN | 212272085 | U | 1/2021 | |
| DE | 202014102391 | U | 8/2014 | |
| DE | 202018105187 | U1 * | 1/2019 | ..... B25B 27/0035 |
| EP | 2484495 | A1 | 8/2012 | |
| EP | 3330014 | A1 | 11/2017 | |
| EP | 3623109 | A1 | 3/2020 | |
| GB | 2531779 | A | 10/2014 | |
| GB | 2531779 | A * | 5/2016 | ..... B25B 27/0035 |
| TW | 200303808 | A | 9/2003 | |
| WO | 8000534 | A1 | 4/1980 | |

OTHER PUBLICATIONS

Combined Search and Examination Report for corresponding Application No. GB2201406.2 dated Jul. 27, 2022, 7 pages.

Taiwan Office Action for corresponding Application No. 11120737890 dated Jul. 28, 2022, 11 pages.

Examination Report No. 1 for corresponding Australian Application No. 2022200788 dated Feb. 28, 2023, 4 pages.

Examination Report for corresponding United Kingdom Application No. GB2201406.2 dated Mar. 24, 2023, 5 pages.

* cited by examiner

DEAD BLOW SLIDE HAMMER

TECHNICAL FIELD OF THE INVENTION

The present invention relates generally to slide hammers. More particularly, the present invention relates to slide hammers with dampening material disposed inside.

BACKGROUND OF THE INVENTION

Slide hammers typically include a sliding mass referred to as a "hammer body" that slides along a shaft to impact a stop that is affixed-to or part-of the shaft. The opposite end of the shaft serves as an attachment point. Upon impact with the stop, inertia from the mass is transferred to the shaft, generating an axial force on the shaft in the direction the mass had been slid. By coupling the attachment point to an object, a pull-force is applied to the object.

Application of a pull force is particularly advantageous when a push or pry force cannot be applied to the other side of the object. Examples of tasks for which slide hammers are useful for include pulling dents out of metal surfaces, removing axle bushings, extracting bearing races, and removing covers or seals.

The pull force provided by conventional slide hammers only lasts for a short period following the hammer body striking the stop, providing a sudden but transitory application of force to the object. Conventional slide hammers also tend to bounce backward upon striking the stop, causing reverberation in the tool. Continued use of such slide hammers can cause discomfort or injury to a user whose body repeatedly absorbs part of the shock from the impact and the reverberation.

SUMMARY OF THE INVENTION

The present invention relates broadly to a slide hammer with a hammer body that rides on a shaft and strikes a stop. The hammer body has one-or-more internal cavities arranged around the long axis of the shaft. The cavity or cavities contain a dampening material, such as steel, lead, sand, or copper pellets, often called "shot." There can also be a singular slug or fixed number of slugs per cavity that make up the dampening material. The inclusion of the dampening material creates the "dead blow" effect, increasing the duration of the pull-force generated by the impact and the overall efficiency of the slide hammer strike, while insulating a user from the shocking impact of a typical conventional slide hammer.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
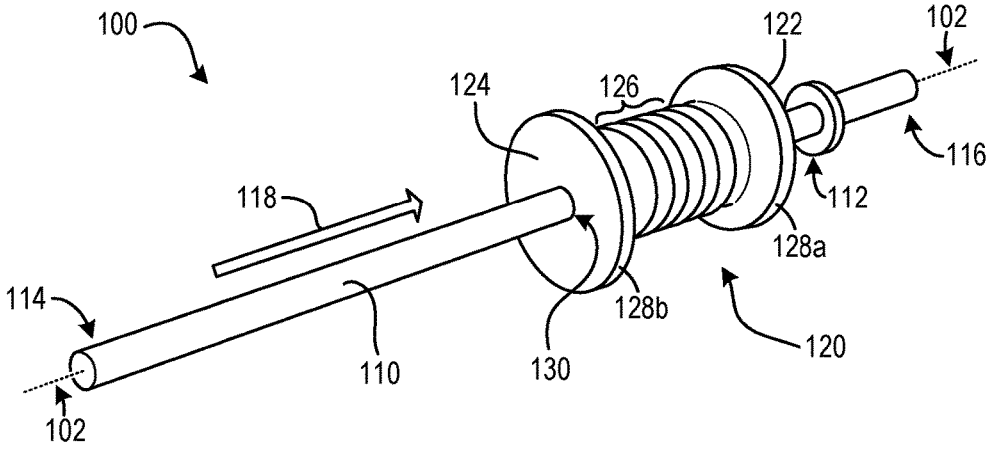
FIG. 1 is a perspective, side view of a dead blow slide hammer assembly, with a two-piece hammer body according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a slide hammer with a hammer body that rides on a shaft and strikes a stop. The hammer body has one-or-more internal cavities arranged around the long axis of the shaft. The cavity or cavities contain a dampening material, such as steel, lead, sand, or copper pellets, often called "shot." There can also be a singular slug or fixed number of slugs per cavity that make up the dampening material. The inclusion of the dampening material creates a "dead blow" effect, increasing the duration of the pull-force generated by the impact and the overall efficiency of the slide hammer strike, while insulating a user from the shocking impact of a typical conventional slide hammer.

Referring to FIG. 1, an embodiment of the present invention broadly comprises a slide hammer assembly 100 that includes a hammer body 120 sliding along a slide shaft 110, such as but not limited to, a steel rod. A first end 114 of the shaft 110 serves as an attachment point for coupling the dead blow slide hammer assembly 100 to an object being worked upon, and may be threaded. A second end 116 of the shaft 110 may include or be coupled to a handle.

The hammer body 120 has a through bore 130 extending longitudinally therethrough that slidably receives the slide shaft 110. The through bore 130 has cross-sectional dimensions, orthogonal to the long axis 102 of the slide shaft 110 and the hammer body 120, slightly larger than the cross-sectional dimensions of the external "slide" surface of the slide shaft 110, so as to allow the hammer body 120 to slide on the external slide surface of the slide shaft 110.

The hammer body 120 has a middle section 126, which is illustrated as cylindrical, but can have any cross-sectional configuration. The outer surface of the middle section 126 may be ribbed, knurled, or textured to provide a grip or handhold. The hammer body 120 may also have flanged ends 128*a*, 128*b* that extend radially away from the long axis 102 to have a larger cross-section than the middle section 126. The flanges 128*a* and 128*b* help protect a user's hand and/or fingers when gripping the middle section 126 to slide the hammer body 120 along the shaft 110.

A slide stop 112 is coupled to or integrally part of the shaft 110, proximate to the second end 116. The slide stop 112 has cross-sectional dimensions, orthogonal to the axis 102, larger than the cross-sectional dimensions of the through bore 130. The hammer body 120 slides along the shaft 110 in a direction 118 until an impact surface 122 of the hammer body 120 collides with the slide stop 112, producing an axial force along the shaft 110 in the direction 118. Optionally, a second stop (not illustrated) may be included proximate to the first end 114, to impede a non-impact surface 124 of the hammer body 120 from sliding past the first end 114.

Figure 2:
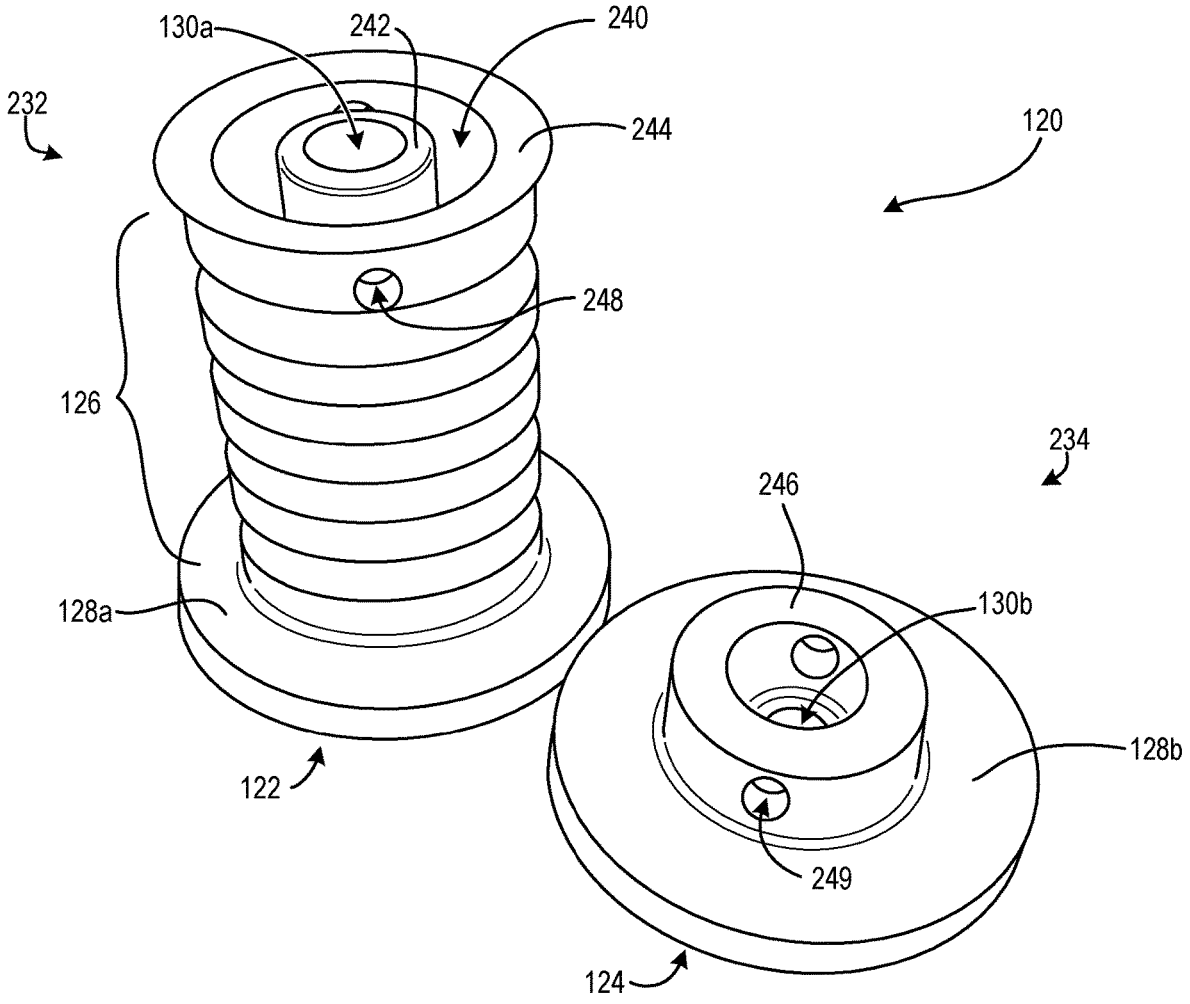
FIG. 2 is a perspective view of component parts of the hammer body of FIG. 1.
Figure 3:
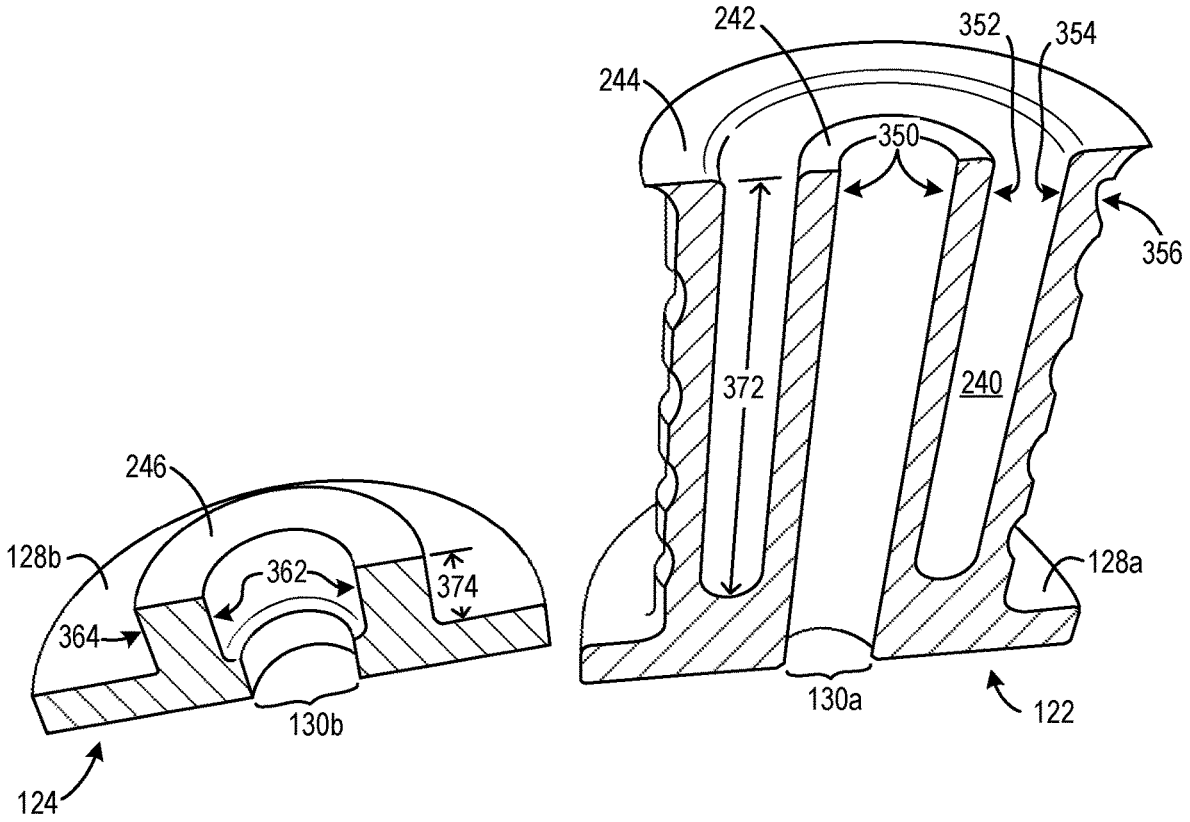
FIG. 3 is a perspective cross-sectional view of the component parts of the hammer body of FIGS. 1 and 2, sliced along the long axis of the hammer body.
Figure 4:
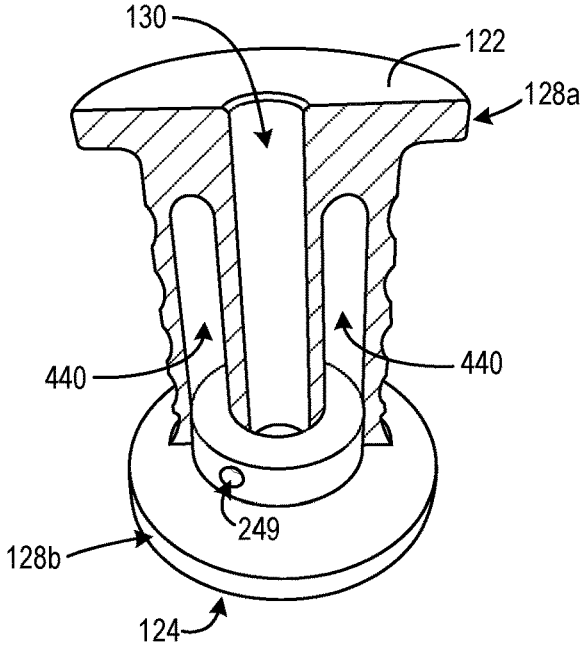
FIG. 4 is a perspective cross-sectional view of a main part of the hammer body from FIG. 3, as assembled with a cap part from FIG. 2 shown in a perspective view.
Figure 5:
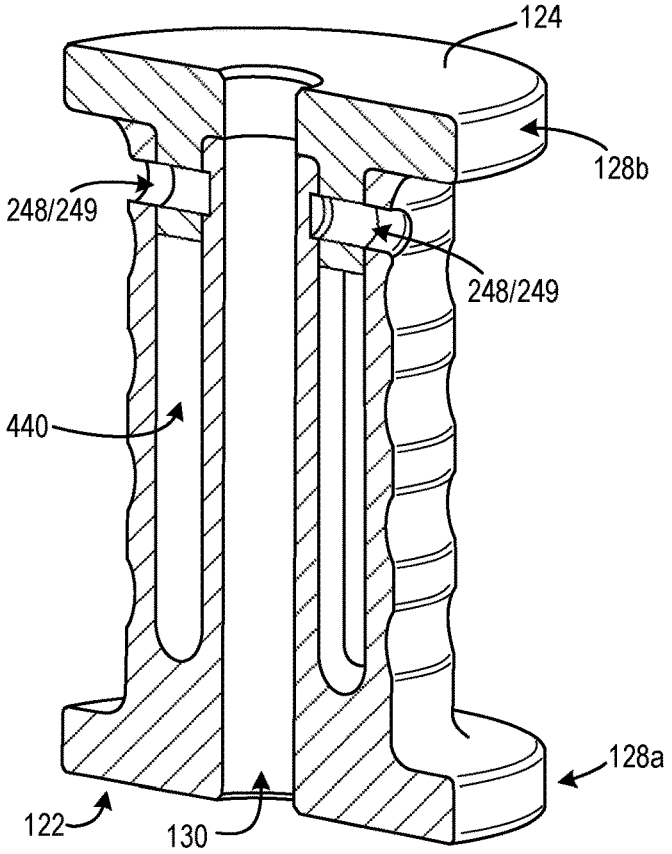
FIG. 5 is a perspective cross-sectional view of the assembled hammer body from FIGS. 1-4.

FIG. 2 is a perspective view of the component parts of the two-piece hammer body 120, including a main body 232 and a cap 234 that are secured together to form the hammer body 120 as an integral structure. FIG. 3 is a cut-away view of the main body 232 and the cap 234. FIG. 4 is a perspective cross sectional view of the main body 232, as assembled with the cap 234 shown in a perspective view. FIG. 5 is a perspective cross sectional view of the assembled hammer body 120. The main body 232 includes the middle section 126 and the first flange 128*a*, while the cap 234 provides the second flange 128*b*.

Referring to FIG. 3, relative to the long axis 102 shown in FIG. 1, the main body 232 may be formed as a monolithic structure including a concentric inner wall 242 and a concentric outer wall 244, with a concentric longitudinal bore 240 therebetween that surrounds or wraps around (encircles) the long axis 102 and the through bore 130. The longitudinal bore 240 is closed at the impact-surface end of the main body 232, but open at the opposing end of the main body 232. The radially-inner surface 350 of the inner wall 242 forms the through bore 130*a* that receives the external surface of the shaft 110. The radially-outer surface 352 of the inner wall 242 forms the inside edge of the concentric longitudinal bore 240. The radially-inner surface 354 of the outer wall 244 forms the outside edge of the concentric longitudinal bore 240. The radially-outer surface 356 of the outer wall 244 provides the grip or handhold of the middle section 126.

The cap 234 includes a concentric protruding ring 246 that is inserted into the bore 240 to close and/or seal off the end of the bore 240, when the main body 232 and cap 234 are coupled together. When assembled, the radially inner surface 362 of the protruding ring 246 abuts the radially-outer surface 352 of the inner wall 242, and the radially outer surface 364 of the protruding ring 246 abuts the radially inner surface 354 of the outer wall 244. As illustrated, the impact surface 122 and the non-impact surface 124 are solid, except for the openings for the through bore 130.

Parallel to the long axis 102, the concentric longitudinal bore 240 has a depth 372 that is greater than the depth 374 of protruding ring 246. When assembled, the portion of the bore 240 not filled by the insertion of the protruding ring 246 provides an internal longitudinal cavity 440 (FIGS. 4 and 5) within the hammer body 120, lateral and concentric to the through bore 130.

Prior to assembly, the portion of the concentric longitudinal bore 240 that forms the cavity 440 shown in FIG. 4 is partially filled with a dampening material (not illustrated), such as steel, lead, sand, or copper pellets often called "shot." There can also be a singular slug or fixed number of slugs per cavity that make up the dampening material. When the impact surface 122 of the hammer body 120 impacts the slide stop 112, the dampening material inhibits rebound and reverberation of the hammer body 120. The inclusion of the dampening material also increases the duration of impact upon striking the stop 112, relative to a solid hammer body having a similar mass.

The main body 232 and the cap 234 may be secured to each other using adhesives, welds, screws, pins, interlocking threads, or other means to secure the parts together and ensure the cavity will retain the dampening material. For example, FIGS. 2, 4, and 5 illustrate through holes 248 through the outer wall 244 of the main body 232, and corresponding through holes 249 through the protruding ring 246 of the cap 234. When assembled, the holes 248 and holes 249 are aligned, and pins or screws may be inserted through the holes 248 and 249 to secure the cap 234 to the main body 232.

The main body 232 and cap 234 may be manufactured, among other ways, by milling, die-casting, injection molding, stamping, or additive manufacturing (also known as 3D printing). The through bore 130*a* and the concentric longitudinal bore 240 may be formed with the main body 232 as an original feature, or excavated by machining, milling, or drilling. Likewise, the through bore 130*b* may be formed with the cap 234 as an original feature, or excavated.

For a consistent finish, durability, and engineering tolerances, the main body 232 and cap 234 may be made from the same material using the same or similar manufacturing processes. However, the main body 232 and cap 234 may be made from different materials. Likewise, the main body 232 and cap 234 may be made using different manufacturing processes.

Figure 6:
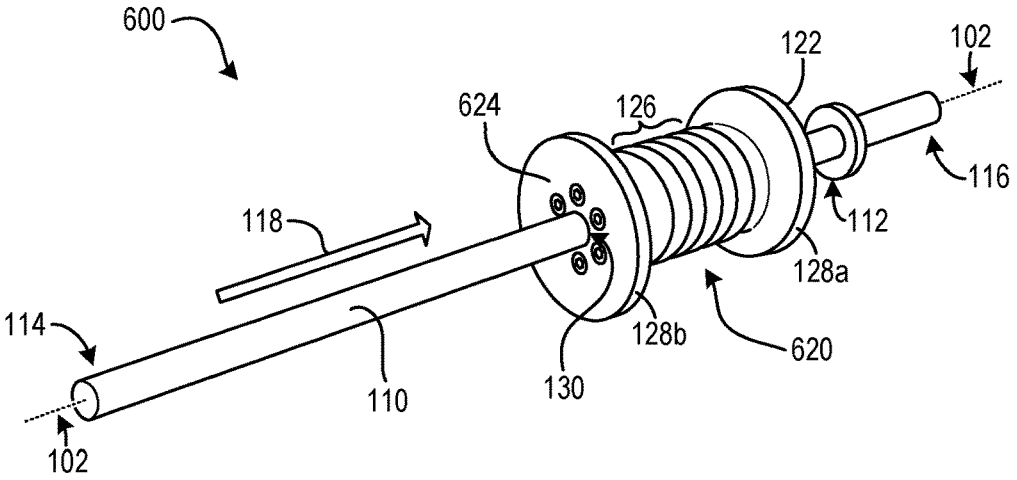
FIG. 6 is a perspective overview of a dead blow slide hammer assembly, with a one-piece hammer body according to an embodiment of the present invention.

FIG. 6 illustrates another embodiment of a dead blow slide hammer assembly 600, which is the same as the dead blow slide hammer 100, except the hammer body 620 is a one-piece (monolithic) structure and the closed-end boring is different. The difference in boring creates multiple cavities within the hammer body 620, each of which is sealed at a non-impact surface 624. The operation and features of the dead blow slide hammer assembly 600 are otherwise similar to or the same as those of slide hammer assembly 100.

The hammer body 620 slides along the slide shaft 110 to collide with the slide stop 112. The first end 114 of the shaft 110 serves as the attachment point for coupling the dead blow slide hammer assembly 600 to the object being worked upon, and may be threaded. The second end 116 of the shaft 110 may include or be coupled to a handle. The hammer body 620 includes the through bore 130 extending longitudinally there through that receives the slide shaft 110. The through bore 130 has cross-sectional dimensions, orthogonal to the long axis 102 of the slide shaft 110 and the hammer body 620, larger than the cross-section of external "slide" surface of the slide shaft 110, so as to allow the hammer body 620 to slide freely on the external slide surface of the slide shaft 110.

The hammer body 620 includes the middle section 126, which is illustrated as cylindrical. The outer surface of the middle section 126 may be ribbed, knurled, or textured to provide a grip or handhold. The hammer body 620 may also have the flanged ends 128*a*, 128*b* that extend radially away from the long axis 102 to have a larger cross-section than the middle section 126.

The hammer body 620 colliding with the slide stop 112 produces an axial force along the shaft 110 in the direction 118. Optionally, a second stop (not illustrated) may be included proximate to the first end 114, to impede the non-impact surface 624 of the hammer body 620 from sliding past the first end 114.

Figure 7:
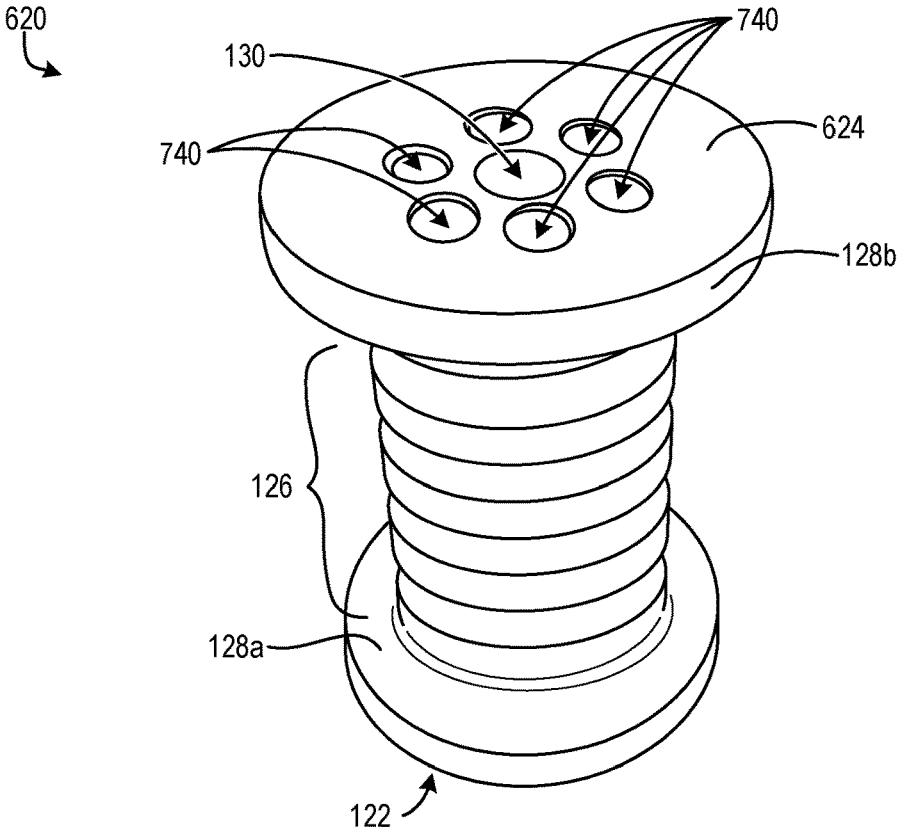
FIG. 7 is a perspective view of the one-piece hammer body of FIG. 6.
Figure 8:
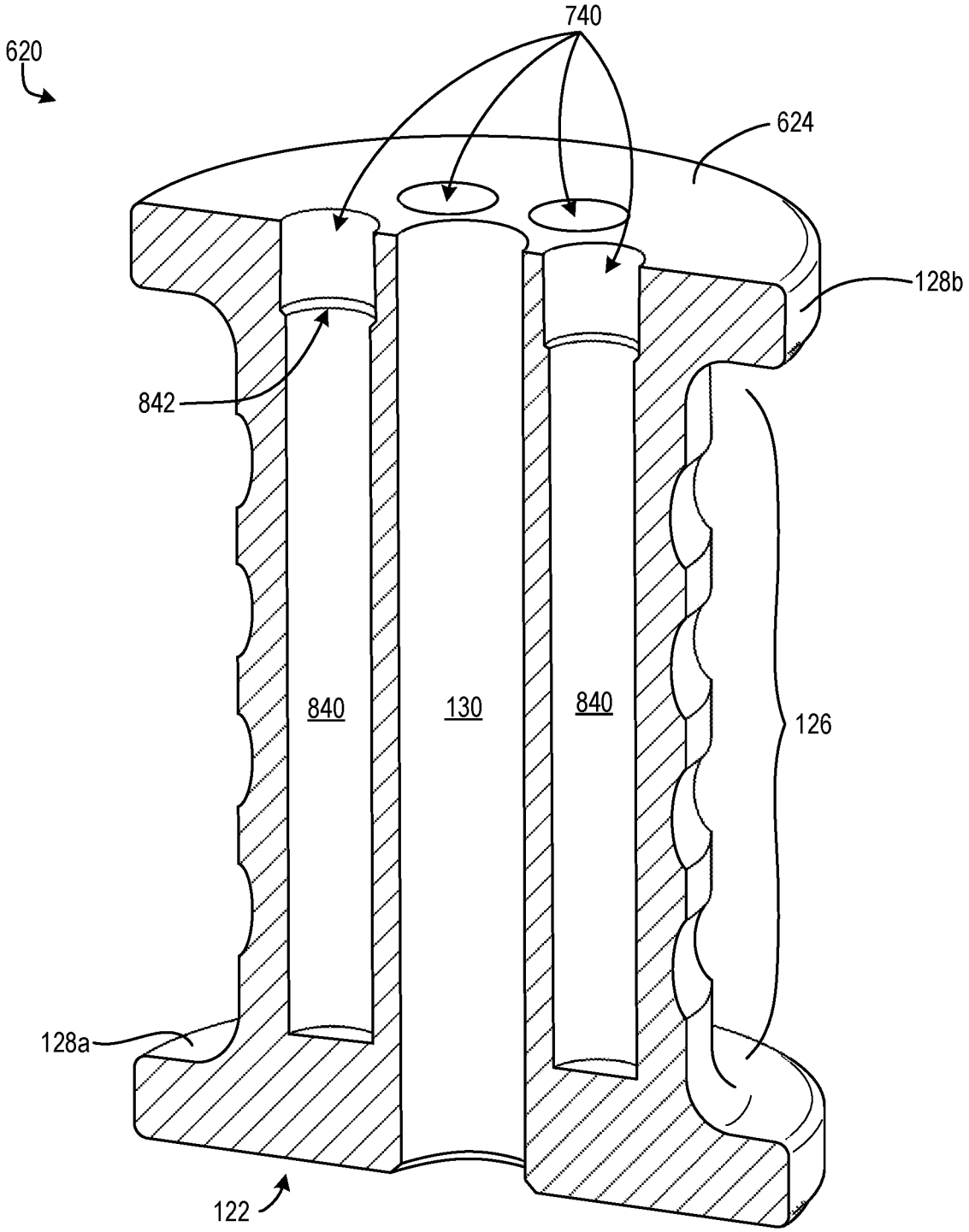
FIG. 8 is a perspective cross-sectional view of the one-piece hammer body from FIGS. 6 and 7, sliced along the long axis of the hammer body.

FIG. 7 is a perspective view of the one-piece hammer body 620, and FIG. 8 is a perspective cross sectional view of the one-piece body hammer 620. A plurality of longitudinal bores 740 are arranged around the long axis 102 and the through bore 130, extending from the non-impact surface 624 of the hammer body 620 into the middle portion 126. Each longitudinal bore 740 is closed at impact-surface 122, but initially open at the opposing non-impact surface 624.

The open end of the longitudinal bores 740 may be sealed using welds, plugs, set screws, or similar means to seal the longitudinal bores 740, resulting in sealed longitudinal cavities 840 (FIG. 8) arranged around the through bore 130. As illustrated, there are six longitudinal bores 740. However, six is an example, and less than or more than six bores 740 may be included.

The open ends of the longitudinal bores 740 exposed through the non-impact surface 624 may have a larger diameter than the rest of the corresponding bore 740, providing a seat 842 for the seal. All or a portion of each seal has a diameter that is larger than a diameter of the seat 842. The seat 842 facilitates insertion of the seals to a consistent depth, and finishing the surface 624 so that an exposed surface of each seal is at or below the surface 624. If threaded seals such as set screws are used, the open ends of the longitudinal bores 740 may also be threaded to mate with peripheral threads of each seal.

Prior to sealing, each of the longitudinal cavities 840 is partially filled with a dampening material, as discussed in connection with the cavity 440 of the hammer body 120. When the impact surface 122 of the hammer body 620 impacts the slide stop 112, the dampening material inhibits rebound and reverberation of the hammer body 620. The inclusion of the dampening material also increases the duration of impact upon striking the stop 112, relative to a solid hammer body having a similar mass.

Figure 9:
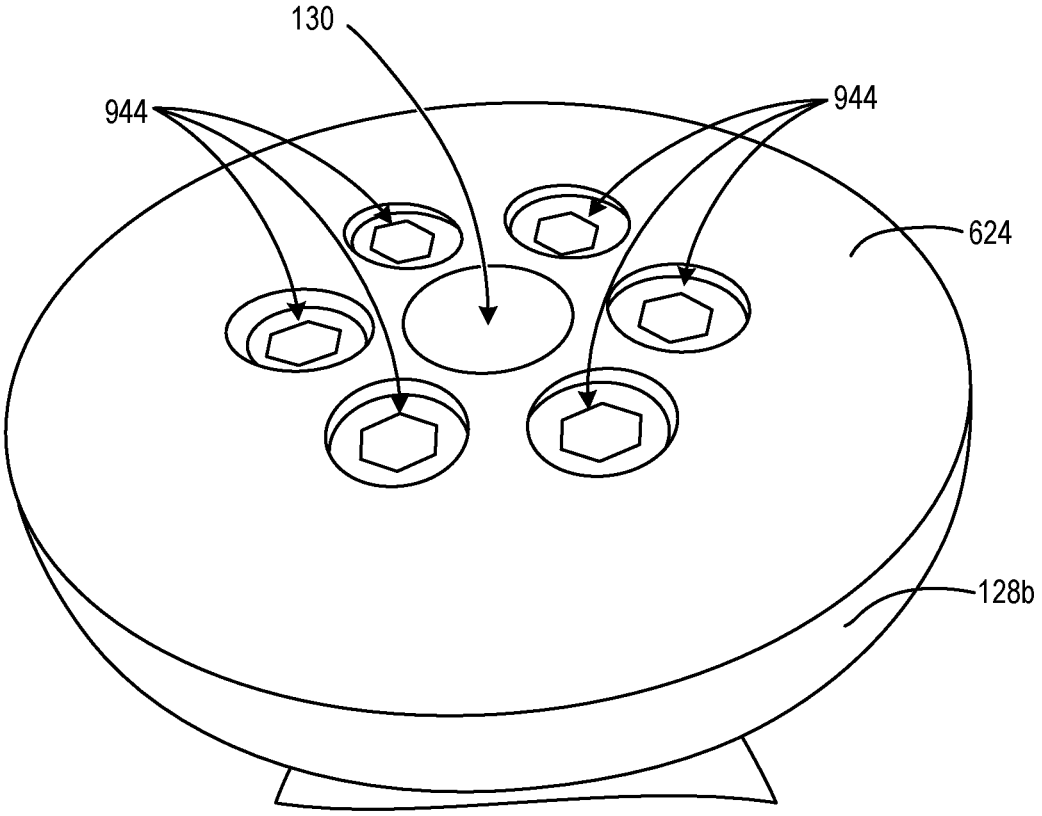
FIG. 9 is a perspective view of bore openings of the hammer body of FIGS. 6-8, illustrating an example of sealing the bore openings.

FIG. 9 is a perspective view of the non-impact surface 624 illustrating an example of sealed longitudinal bores 740. As illustrated, each longitudinal bore 740 is sealed by a threaded plug or set-screw 944 having a hexagonal socket head.

The one-piece hammer body 620 may be manufactured, among other ways, by milling, die-casting, injection molding, stamping, or additive manufacturing (also known as 3D printing). The through bore 130 and the plurality of longitudinal bores 740 may either be formed as original features, or excavated by machining, milling, or drilling.

Inclusion of the dampening material in the cavity 440 and the cavities 840 increases the duration of the impact when the hammer bodies 120 and 620 strike the stop 112. The extended duration of the hammer blow due to the internal dampening material works to the advantage of the user in most circumstances.

The impact that occurs with a conventional slide hammer configuration can cause fatigue or injury to a user because of the transfer of the hammer shock through the handle and into the arm and shoulder area of the user. With a dead blow slide hammer assembly 100/600, the shock will not transfer as much bounce or reverberation. This will result in less force being transferred to the user and reduce the risk of fatigue and injury.

Although the slide shaft 110, the through bore 130, and hammer bodies 120/620 are illustrated as having cylindrical features with round cross-sections (orthogonal to the axis 102), other cross-sectional profiles may be used. For example, the slide shaft 110 and the through bore 130 may have square cross-sections or other shaped cross-sections. As another example, the middle portion 126 may be shaped to provide a defined hand-grip, such as having nubs along one side to align finger position.

Figure 10:
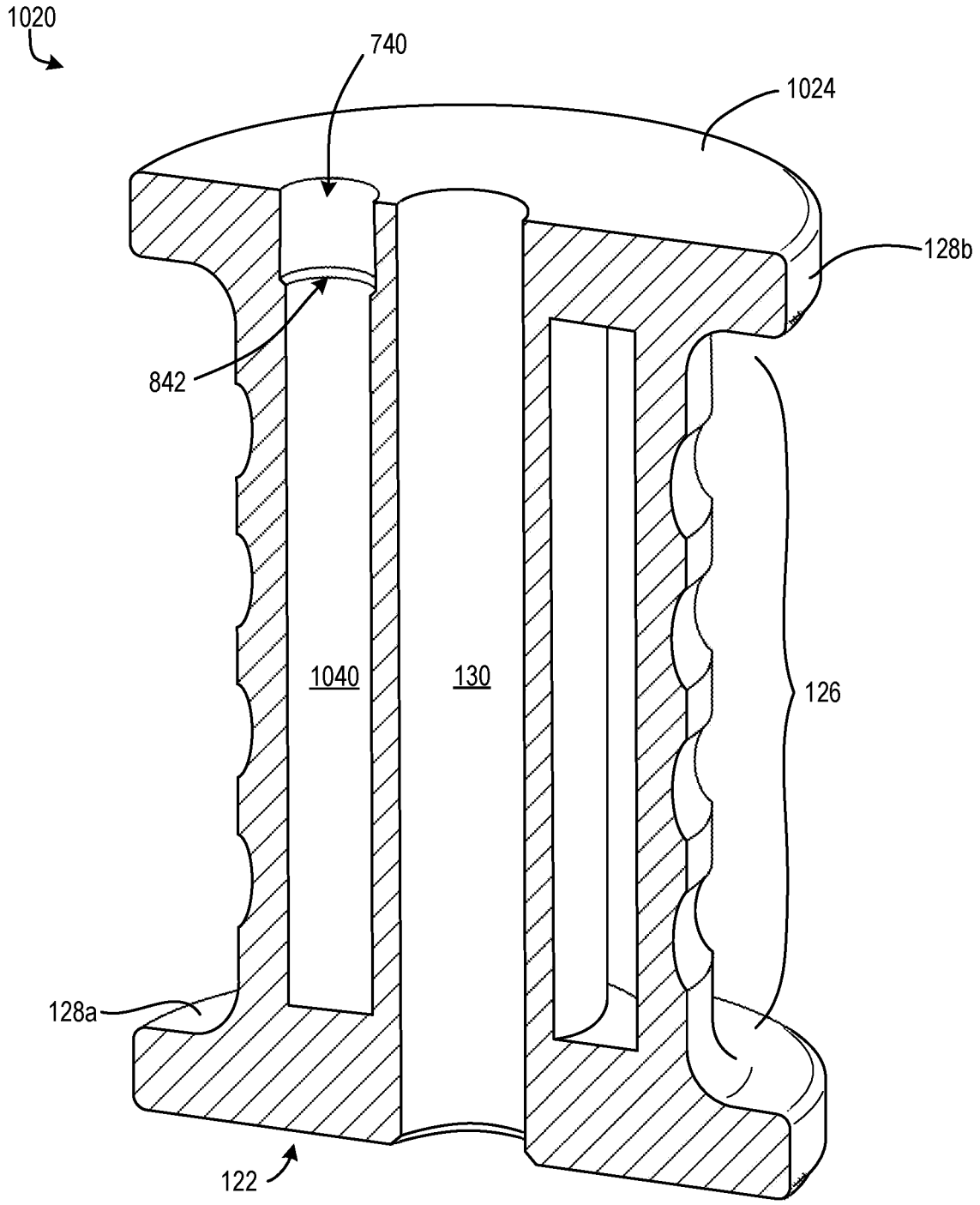
FIG. 10 is a perspective cross-sectional view of another one-piece hammer body according to an embodiment of the present invention.

Aspects of hammer body 120 and the hammer body 620 can be combined to form hammer body 1020 illustrated in FIG. 10. For example, the main body 232 and the cap 234 may be integrated together prior to adding the dampening material forming hammer body 1020 with non-impact surface 1024, as illustrated in FIG. 10. A "fill" through-bore 740 may be provided through the non-impact surface 1024 or the middle portion 126 for access to the internal cavity 1040 (similar to internal cavity 440) from outside the assembled hammer body. Via the fill through-bore 740, the internal cavity 1040 is partially filled with the dampening material, and then sealed using a plug, set-screw, or similar hardware (e.g., a threaded seal 944). The fill through-bore 740 may include a seat 842, and may be threaded.

As another example of a combination, the hammer body 1020, similar to assembled hammer body 120, may be formed as a single-piece monolithic structure using additive manufacturing techniques, forming the internal cavity 1040 as an original internal feature within the structure. The through bore 130 may be an original feature, or may be added. Likewise, a "fill" through-bore may be provided or added through the non-impact surface 1024 or the middle portion 126 for external access to the internal cavity 1040. Via the fill through-bore, the internal cavity 1040 is partially filled with the dampening material, and then sealed using a weld, plug, set-screw, or similar means (e.g., a threaded seal 944). The open end of the fill through-bore may include a seat 842, and may be threaded.

Figure 11:
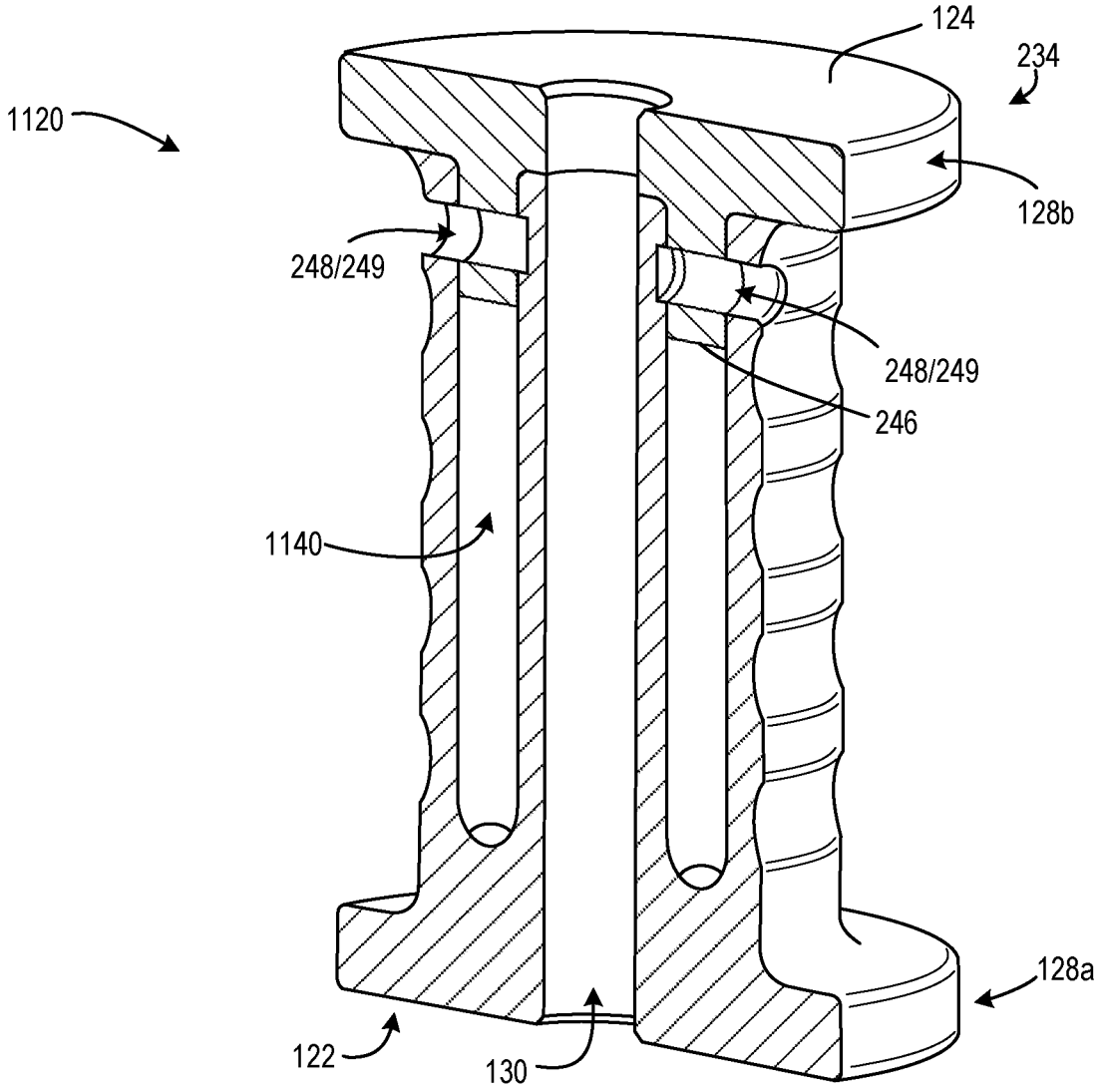
FIG. 11 is a perspective cross-sectional view of another two-piece hammer body according to an embodiment of the present invention.

Another example of a combination uses a two-piece hammer body like that used for hammer body 120 is illustrated as hammer body 1120 in FIG. 11. The main body may have a longitudinal bore 1140 (similar to bore 840) that is deeper than the length of protruding ring 246, providing a seat for the cap 234. A plurality of longitudinal bores 1140 may extend from the seat into the middle portion 126 of the hammer body, arranged as a plurality of longitudinal bores 1140 around the through bore 130. After the plurality of cavities are filled with the dampening material, the main body and cap are integrated, resulting in a hammer body that looks similar to the hammer body 120 from the outside, but which contains a plurality of internal cavities 1140 having features corresponding to cavities 840 of hammer body 620, as illustrated in FIG. 8.

To promote durability, the preferred arrangement is to have the sealed end(s) of the bores 240, 440, 840, 1040, and 1140 facing away from the stop 112. However, the slide hammer assemblies 100/600 are equally operable with hammers mounted on the shaft 110 in the opposite direction, swapping the illustrated non-impact surface 124/624 and impact surface 122.

Figure 12:
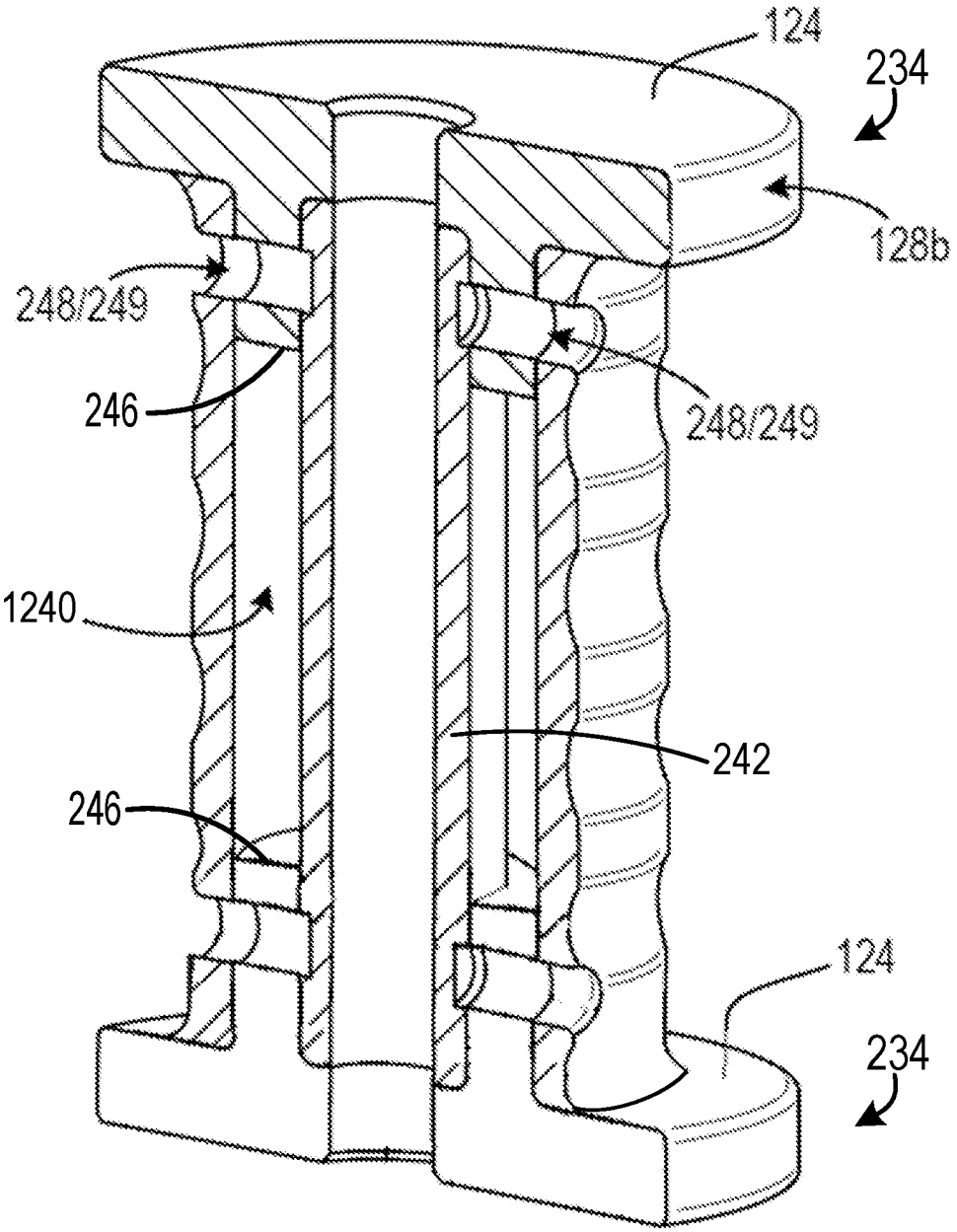
FIG. 12 is a perspective cross-sectional view of another hammer body according to an embodiment of the present invention.

Additionally, as illustrated in FIG. 12, the slide hammer body 120 can incorporate 2 caps 234, one at each end of the assembly. The concentric inner wall 242 can be a length of tube material. When assembled the radially-outer surface of the tube abuts the radially inner surface of the protruding rings 246 at both ends of the slide hammer body when assembled to form the internal cavity (such as cavity 1240).

Any of the various adapters conventionally used with slide hammer assemblies may be affixed to attachment point at the first end 114 of the shaft 110, for coupling the shaft 110 to the object being worked upon. Examples of adapters that can be affixed at the attachment point include, among other things, grabbing jaws, stud adapters, dent pullers, bearing hooks, suction cups, grease-port retainer adapters, etc.

From the foregoing, it can be seen that there has been described a dead blow slide hammer with improved force-delivering capacity, and improved reverberation resistance and ergonomic design.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A slide hammer assembly, comprising:

a shaft having first and second shaft ends, the first shaft end includes an attachment point;

a stop coupled to the shaft proximate to the second shaft end;

a hammer body having opposing first and second flanged body ends, the hammer body including a main body portion with an outer surface having a gripping portion disposed between the first and second flanged body ends, a cap portion coupled to the main body portion, and a through bore extending longitudinally through the hammer body and that slidably receives the shaft and allows the hammer body to slide on an external surface of the shaft, wherein the main body portion includes a longitudinal bore encircling the through bore, and the cap portion closes the longitudinal bore to cooperatively form an internal cavity longitudinally between the first and second flanged body ends and laterally between the gripping portion and the through bore; and a dampening material disposed in the internal cavity.

2. The slide hammer of claim 1, wherein the dampening material includes one or more of a slug, steel pellets, lead pellets, sand, or copper pellets.

3. The slide hammer of claim 1, wherein the main body portion has inner and outer walls with the longitudinal bore disposed there between, an inner surface of the inner wall forms the through bore, an outer surface of the inner wall is an inside edge of the longitudinal bore, and an inner surface of the outer wall is an outside edge of the longitudinal bore.

4. The slide hammer of claim 3, wherein the gripping portion is at least one of ribbed, knurled, and textured.

5. The slide hammer of claim 1, wherein the cap portion includes a protruding feature that is inserted into a portion of the longitudinal bore, a remainder of the longitudinal bore not filled by the protruding feature forming the internal cavity.

6. The slide hammer of claim 1, wherein the main body portion is monolithic.

* * * * *